US011342139B1

(12) United States Patent
Zhu et al.

(10) Patent No.: US 11,342,139 B1
(45) Date of Patent: May 24, 2022

(54) KEY STRUCTURE

(71) Applicant: Primax Electronics Ltd., Taipei (TW)

(72) Inventors: De-Guang Zhu, Taipei (TW); Rong-Biao Xu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/165,595

(22) Filed: Feb. 2, 2021

(30) Foreign Application Priority Data

Nov. 25, 2020 (CN) ..... 202011337661.5

(51) Int. Cl.
*H01H 13/20* (2006.01)
*H01H 13/10* (2006.01)
*H01H 13/14* (2006.01)

(52) U.S. Cl.
CPC ..... *H01H 13/20* (2013.01); *H01H 13/10* (2013.01); *H01H 13/14* (2013.01); *H01H 2233/07* (2013.01)

(58) Field of Classification Search
CPC ..... H01H 13/20; H01H 13/14; H01H 13/10; H01H 2233/07; H01H 13/7065; H01H 3/125; H01H 13/70; H01H 13/705; H01H 3/12; H01H 3/122
USPC ..... 200/341, 344, 345
See application file for complete search history.

(56) References Cited

U.S. PATENT DOCUMENTS

| | | | | |
|---|---|---|---|---|
| 9,087,650 | B2 * | 7/2015 | Ma | H01H 3/122 |
| 10,276,325 | B2 * | 4/2019 | Chung | H01H 13/84 |
| 10,312,036 | B2 * | 6/2019 | Chen | H01H 13/86 |
| 10,586,662 | B2 * | 3/2020 | Wu | H01H 3/125 |

* cited by examiner

*Primary Examiner* — Lheiren Mae A Caroc
(74) *Attorney, Agent, or Firm* — Kirton McConkie; Evan R. Witt

(57) ABSTRACT

A key structure includes a keycap, a base plate, a first scissors-type connecting element, a second scissors-type connecting element and a reinforced connecting rod. The first and second scissors-type connecting elements are arranged between the keycap and the base plate. The first scissors-type connecting element includes a first inner frame and a first outer frame. The second scissors-type connecting element includes a second inner frame and a second outer frame. The keycap is movable upwardly or downwardly relative to the base plate along a specified path with the assistance of the first and second scissors-type connecting elements. The reinforced connecting rod includes a hollow rectangular main body. The first outer frame has a first extension structure. The second outer frame has a second extension structure. Moreover, two opposite sides of the hollow rectangular main body are respectively received within the first extension structure and the second extension structure.

14 Claims, 10 Drawing Sheets

KEY STRUCTURE

FIELD OF THE INVENTION

The present invention relates to a key structure, and more particularly to a multiple key structure with a reinforced connecting rod and a stabilizer rod.

BACKGROUND OF THE INVENTION

Generally, a key structure of a keyboard device comprises ordinary key structures and some special key structures (e.g., multiple key structures). Since the length of the multiple key structure is much larger than its width, some drawbacks occur. For example, while the multiple key structure is pressed down by the user, the multiple key structure is readily tilted and even jammed. For solving this problem, a metallic connecting rod on a base plate of the key structure or an inner side of a keycap of the key structure in order to stabilize and reinforce the key structure. However, the metallic connecting rod occupies an additional inner space of the key structure, and the metallic connecting rod readily collides with the base plate or the keycap to generate noise.

In accordance with a conventional method, the metallic connecting rod is connected with an ascending/descending mechanism such as a scissors-type connecting element. However, the structural strength of the scissors-type connecting element is possibly influenced, or the thickness of the key structure is increased because the metallic connecting rod is installed over the scissors-type connecting element.

In other words, the conventional key structure needs to be further improved.

SUMMARY OF THE INVENTION

For solving the drawbacks of the conventional technologies, the present invention provides a key structure. The key structure includes a scissors-type connecting element, a reinforced connecting rod and a stabilizer rod. The reinforced connecting rod and the stabilizer rod are connected with the scissors-type connecting element. Especially, the thickness of the key structure is not increased, and the structural strength of the scissors-type connecting element is not adversely affected. Moreover, according to the structural design, the key structure of the present invention can be automatically assembled to achieve the labor-saving efficacy.

In accordance with an aspect of the present invention, a key structure is provided. The key structure includes a keycap, a base plate, a first scissors-type connecting element, a second scissors-type connecting element and a reinforced connecting rod. The first scissors-type connecting element is arranged between the keycap and the base plate. The first scissors-type connecting element is upwardly assembled with the keycap and downwardly assembled with the base plate. The first scissors-type connecting element includes a first inner frame and a first outer frame. The second scissors-type connecting element is arranged between the keycap and the base plate. The second scissors-type connecting element is upwardly assembled with the keycap and downwardly assembled with the base plate. The second scissors-type connecting element includes a second inner frame and a second outer frame. The keycap is movable upwardly or downwardly relative to the base plate along a specified path with the assistance of the first scissors-type connecting element and the second scissors-type connecting element. The reinforced connecting rod includes a hollow rectangular main body. A first side of the first outer frame is away from the second outer frame. A second side of the first outer frame is close to the second outer frame. A first side of the second outer frame faces the first outer frame. A second side of the second outer frame is away from the first outer frame. The second side of the first outer frame has a first extension structure. The first side of the second outer frame has a second extension structure. Moreover, two opposite sides of the hollow rectangular main body are respectively received within the first extension structure and the second extension structure.

In an embodiment, the first extension structure includes a first buried recess, the second extension structure includes a second buried recess, and the two opposite sides of the hollow rectangular main body are respectively received within the first buried recess and the second buried recess.

In an embodiment, at least one first transverse engaging structure is installed on the first buried recess, and at least one second transverse engaging structure is installed on the second buried recess. The reinforced connecting rod is fixed in the first buried recess and the second buried recess through the at least one first transverse engaging structure and the at least one second transverse engaging structure.

In an embodiment, at least one longitudinal engaging structure is installed on the first buried recess, and at least one second longitudinal engaging structure is installed on the second buried recess. The reinforced connecting rod is fixed in the first buried recess and the second buried recess through the at least one first longitudinal engaging structure and the at least one second longitudinal engaging structure.

In an embodiment, the reinforced connecting rod includes a notch, and an upright stopping wall is formed in the first longitudinal engaging structure. The stopping wall is accommodated within the notch.

In an embodiment, the first scissors-type connecting element has a first fixed end and a first slidable end, the second scissors-type connecting element has a second fixed end and a second slidable end, and the key structure further includes a stabilizer rod with a main rod part, two first bent parts and two second bent parts. Each first bent part is arranged between the main rod part and the corresponding second bent part. The two first bent parts are formed by inwardly bending two ends of the main rod part at a specified angle. Each second bent part is formed by bending an end of the corresponding first bent part that is located away from the main rod part. The first outer frame includes at least one first transverse locking groove at an outer side of the first fixed end. The first side of the first outer frame includes a buried-type first transverse engaging structure. The second outer frame includes at least one second transverse locking groove at an outer side of the second fixed end. The second side of the second outer frame includes a buried-type second transverse engaging structure. The main rod part is received within the at least one first transverse locking groove and the at least one second transverse locking groove. The two second bent parts are respectively locked into the first transverse engaging structure and the second transverse engaging structure. Consequently, the first scissors-type connecting element and the second scissors-type connecting element are connected with each other through the stabilizer rod.

In accordance with another aspect of the present invention, a key structure is provided. The key structure includes a keycap, a base plate, a first scissors-type connecting element, a second scissors-type connecting element and a stabilizer rod. The first scissors-type connecting element is arranged between the keycap and the base plate. The first scissors-type connecting element is upwardly assembled with the keycap and downwardly assembled with the base plate. The first scissors-type connecting element includes a first inner frame and a first outer frame. The first scissors-type connecting element has a first fixed end and a first slidable end. The second scissors-type connecting element is arranged between the keycap and the base plate. The second scissors-type connecting element is upwardly assembled with the keycap and downwardly assembled with the base plate. The second scissors-type connecting element includes a second inner frame and a second outer frame. The second scissors-type connecting element has a second fixed end and a second slidable end. The keycap is movable upwardly or downwardly relative to the base plate along a specified path with the assistance of the first scissors-type connecting element and the second scissors-type connecting element. The stabilizer rod includes a main rod part, two first bent parts and two second bent parts. Each first bent part is arranged between the main rod part and the corresponding second bent part. The two first bent parts are formed by inwardly bending two ends of the main rod part at a specified angle. Each second bent part is formed by bending an end of the corresponding first bent part that is located away from the main rod part. A first side of the first outer frame is away from the second outer frame. A second side of the first outer frame is close to a first side of the second outer frame. A second side of the second outer frame is away from the first outer frame. The first outer frame includes at least one first transverse locking groove at an outer side of the first fixed end. The first side of the first outer frame includes a buried-type first transverse engaging structure. The second outer frame includes at least one second transverse locking groove at an outer side of the second fixed end. The second side of the second outer frame includes a buried-type second transverse engaging structure. The main rod part is received within the at least one first transverse locking groove and the at least one second transverse locking groove. The two second bent parts are respectively locked into the first transverse engaging structure and the second transverse engaging structure. Consequently, the first scissors-type connecting element and the second scissors-type connecting element are connected with each other through the stabilizer rod.

In an embodiment, the key structure further includes a reinforced connecting rod with a hollow rectangular main body. The second side of the first outer frame has a first extension structure. The first side of the second outer frame has a second extension structure. Moreover, two opposite sides of the hollow rectangular main body are respectively received within the first extension structure and the second extension structure.

In an embodiment, the first extension structure includes a first buried recess, the second extension structure includes a second buried recess, and the two opposite sides of the hollow rectangular main body are respectively received within the first buried recess and the second buried recess.

In an embodiment, at least one third transverse engaging structure is installed on the first buried recess, and at least one fourth transverse engaging structure is installed on the second buried recess. The reinforced connecting rod is fixed in the first buried recess and the second buried recess through the at least one third transverse engaging structure and the at least one fourth transverse engaging structure.

In an embodiment, at least one longitudinal engaging structure is installed on the first buried recess, and at least one second longitudinal engaging structure is installed on the second buried recess. The reinforced connecting rod is fixed in the first buried recess and the second buried recess through the at least one first longitudinal engaging structure and the at least one second longitudinal engaging structure.

In an embodiment, the reinforced connecting rod includes a notch, and an upright stopping wall is formed in the first longitudinal engaging structure. The stopping wall is accommodated within the notch.

In accordance with a further aspect of the present invention, a key structure is provided. The key structure includes a keycap, a base plate, a first scissors-type connecting element, a second scissors-type connecting element, a reinforced connecting rod and a stabilizer rod. The first scissors-type connecting element is arranged between the keycap and the base plate. The first scissors-type connecting element is upwardly assembled with the keycap and downwardly assembled with the base plate. The first scissors-type connecting element includes a first inner frame and a first outer frame. The first scissors-type connecting element has a first fixed end and a first slidable end. The second scissors-type connecting element is arranged between the keycap and the base plate. The second scissors-type connecting element is upwardly assembled with the keycap and downwardly assembled with the base plate. The second scissors-type connecting element includes a second inner frame and a second outer frame. The second scissors-type connecting element has a second fixed end and a second slidable end. A first side of the first outer frame is away from the second outer frame. A second side of the first outer frame is close to the second outer frame. A first side of the second outer frame faces the first outer frame. A second side of the second outer frame is away from the first outer frame. The second side of the first outer frame has a first extension structure. The first side of the second outer frame has a second extension structure. The first outer frame includes at least one first transverse locking groove at an outer side of the first fixed end. The first side of the first outer frame includes a buried-type first transverse engaging structure. The second outer frame includes at least one second transverse locking groove at an outer side of the second fixed end. The second side of the second outer frame includes a buried-type second transverse engaging structure. The reinforced connecting rod includes a hollow rectangular main body. Moreover, two opposite sides of the hollow rectangular main body are respectively received within the first extension structure and the second extension structure. The stabilizer rod includes a main rod part, two first bent parts and two second bent parts. Each first bent part is arranged between the main rod part and the corresponding second bent part. The two first bent parts are formed by inwardly bending two ends of the main rod part at a specified angle. Each second bent part is formed by bending an end of the corresponding first bent part that is located away from the main rod part. The main rod part is received within the at least one first transverse locking groove and the at least one second transverse locking groove. The two second bent parts are respectively locked into the first transverse engaging structure and the second transverse engaging structure. The main rod part and the reinforced connecting rod are connected with each other.

In an embodiment, the first extension structure includes a first buried recess, and the second extension structure includes a second buried recess. A third transverse engaging structure is installed on the first buried recess. A fourth transverse engaging structure is installed on the second buried recess. The two opposite sides of the hollow rectangular main body of the reinforced connecting rod are respectively received within the first buried recess and the second buried recess. The reinforced connecting rod is fixed in the first buried recess and the second buried recess through the third transverse engaging structure and the fourth transverse engaging structure.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1A:
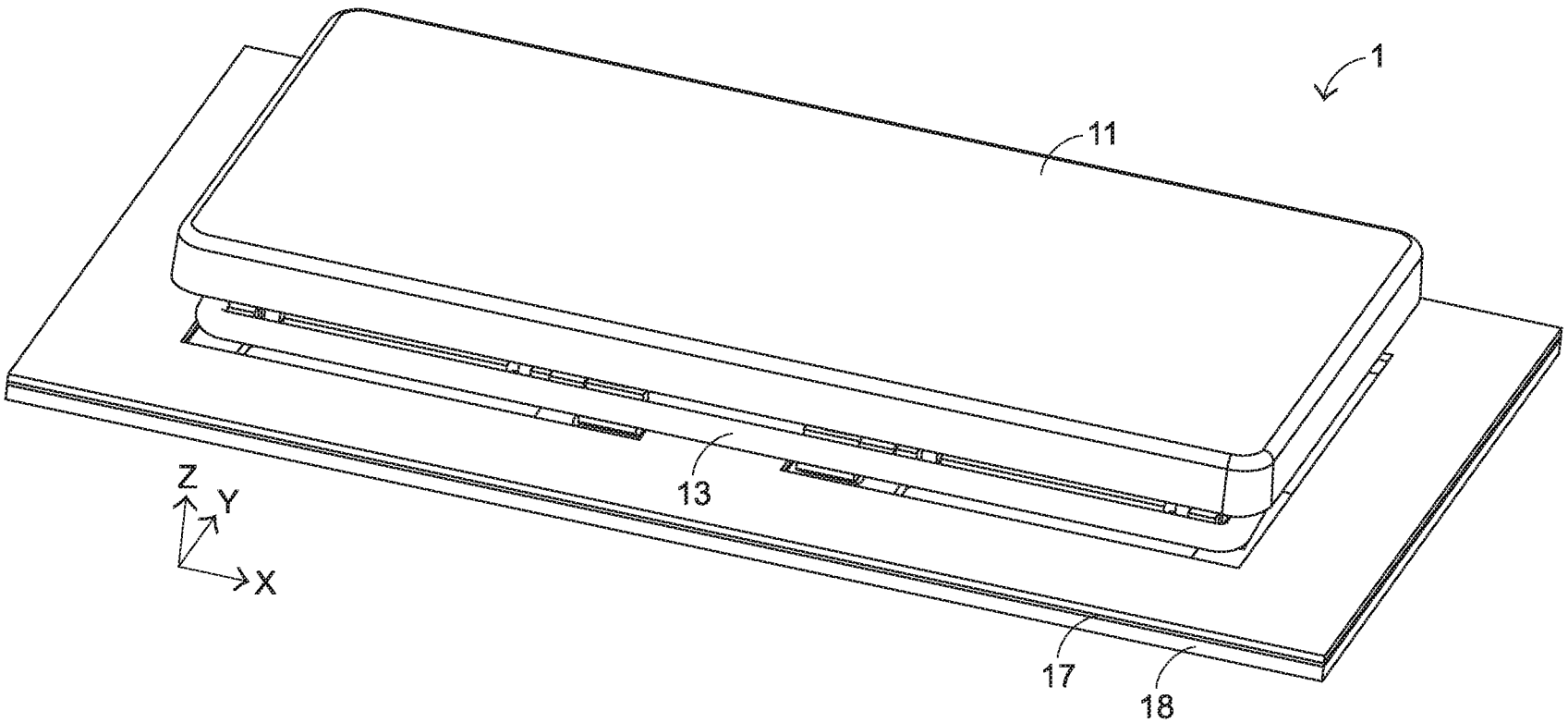
FIG. 1A is a schematic perspective view illustrating a key structure according to a first embodiment of the present invention.
Figure 1B:
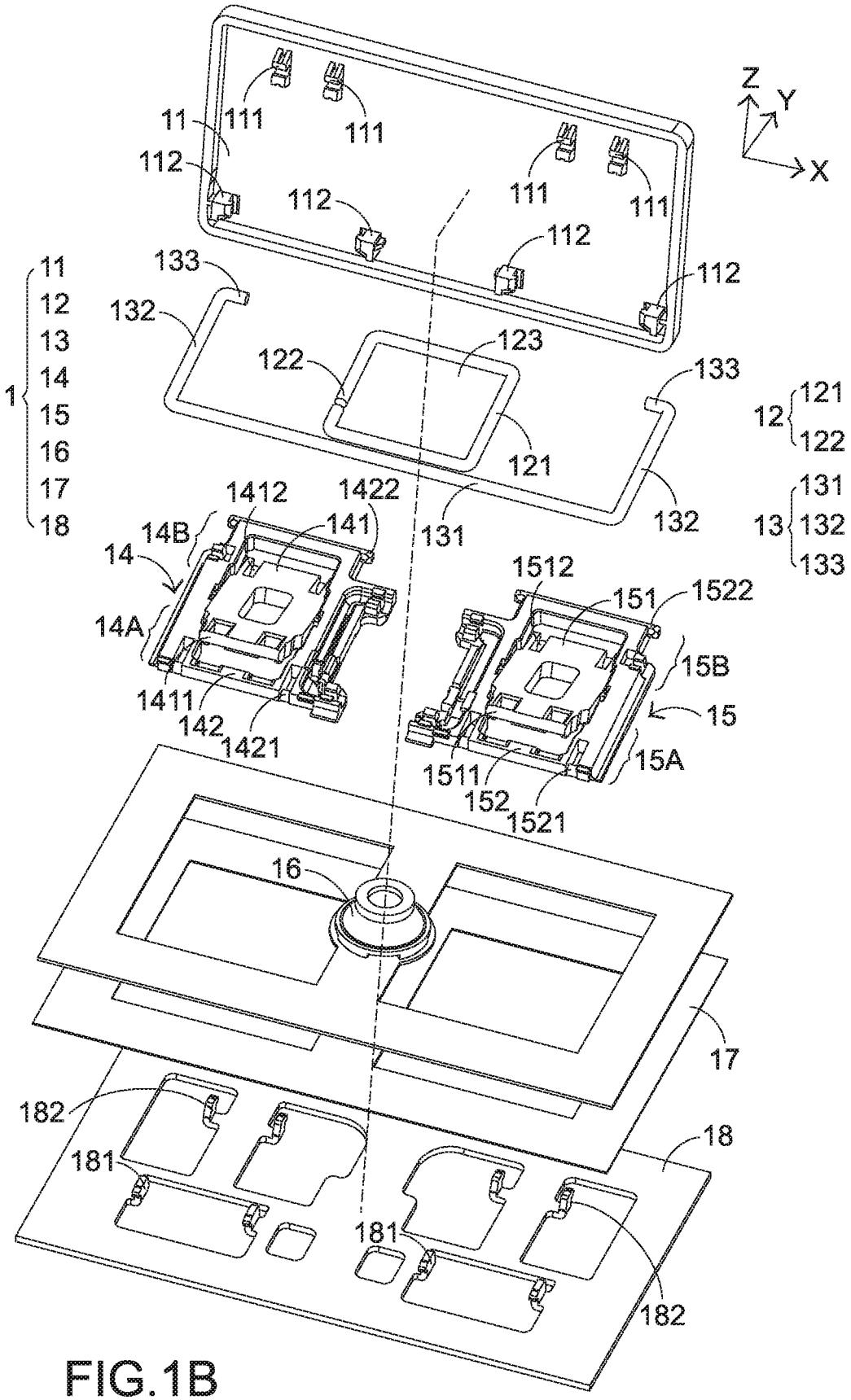
FIG. 1B is a schematic exploded view illustrating the key structure as shown in FIG. 1A.

Please refer to FIGS. 1A and 1B. FIG. 1A is a schematic perspective view illustrating a key structure according to a first embodiment of the present invention. FIG. 1B is a schematic exploded view illustrating the key structure as shown in FIG. 1A. The key structure 1 comprises a keycap 11, a reinforced connecting rod 12, a stabilizer rod 13, a first scissors-type connecting element 14, a second scissors-type connecting element 15, an elastic element 16, a membrane switch 17 and a base plate 18.

According to the structural design, the key structure 1 of this embodiment is applied to a specified key structure such as a multiple key structure. In the multiple key structure, the length of the keycap is larger than the width of the keycap. Consequently, the first scissors-type connecting element 14 and the second scissors-type connecting element 15 are arranged along a horizontal direction (i.e., along the direction parallel with the X axis). The elastic element 16 is arranged between the first scissors-type connecting element 14 and the second scissors-type connecting element 15. As shown in FIG. 2B, the elastic element 16 is disposed within a hollow portion 123 of the reinforced connecting rod 12. The first scissors-type connecting element 14 and the elastic element 16 are arranged along the horizontal direction (i.e., the X-axis direction). The second scissors-type connecting element 15 and the elastic element 16 are arranged along the horizontal direction (i.e., the X-axis direction). That is, the first scissors-type connecting element 14, the elastic element 16 and the second scissors-type connecting element 15 are not overlapped along the vertical direction. Moreover, the elastic element 16 is located at a middle region of the key structure 1. That is, the elastic element 16 is arranged between the first scissors-type connecting element 14 and the second scissors-type connecting element 15. Consequently, while the keycap 11 is pressed down, the elastic element 16 can be successfully subjected to deformation to trigger the underlying membrane switch 17 even if the pressed position is not at the center of the keycap 11.

The first scissors-type connecting element 14 and the second scissors-type connecting element 15 are arranged between the keycap 11 and the base plate 18. The first scissors-type connecting element 14 and the second scissors-type connecting element 15 are upwardly assembled with the keycap 11 and downwardly assembled with the base plate 18. The first scissors-type connecting element 14 comprises a first inner frame 141 and a first outer frame 142. The first inner frame 141 and the first outer frame 142 are rotatable relative to each other in the rotating manner similar to the scissors' rotation. For example, a middle region of the outer side of the first inner frame 141 is equipped with a pivotal shaft (not shown), and a middle region of the inner side of the first outer frame 142 is equipped with a corresponding pivotal hole. After the pivotal shaft is inserted into the pivotal hole, the first inner frame 141 and the first outer frame 142 are rotatable relative to each other. It is noted that the rotation mechanism may be altered or modified. For example, the first inner frame 141 is equipped with the pivotal hole, and the first outer frame 142 is equipped with the pivotal shaft. Alternatively, the first inner frame 141 and the first outer frame 142 have corresponding engaging structures (e.g., convex structures and concave structures). The second scissors-type connecting element 15 comprises a second inner frame 151 and a second outer frame 152. The second inner frame 151 and the second outer frame 152 are rotatable relative to each other. The operations of the second inner frame 151 and the second outer frame 152 are similar to the operations of the first inner frame 141 and the first outer frame 142 of the first scissors-type connecting element 14. Similarly, the rotation mechanism of the second scissors-type connecting element 15 may be altered or modified.

The first scissors-type connecting element 14 has a fixed end 14A and a slidable end 14B. The first inner frame 141 comprises a pivotal shaft 1411 and a slidable shaft 1412. The first outer frame 142 comprises a pivotal shaft 1421 and a slidable shaft 1422. The pivotal shafts 1411 and 1421 are located at the fixed end 14A of the first scissors-type connecting element 14. The slidable shafts 1412 and 1422 are located at the slidable end 14B of the first scissors-type connecting element 14. Similarly, the second scissors-type connecting element 15 has a fixed end 15A and a slidable end 15B. The second inner frame 151 comprises a pivotal shaft 1511 and a slidable shaft 1512. The second outer frame 152 comprises a pivotal shaft 1521 and a slidable shaft 1522. The pivotal shafts 1511 and 1521 are located at the fixed end 15A of the second scissors-type connecting element 15. The slidable shafts 1512 and 1522 are located at the slidable end 15B of the second scissors-type connecting element 15. The keycap 11 comprises plural hooks 111 and plural sliding grooves 112. The base plate 18 comprises plural hooks 181 and 182. When the first scissors-type connecting element 14 and the second scissors-type connecting element 15 are assembled with the keycap 11 and the base plate 18, the pivotal shaft 1411 of the first inner frame 141 and the pivotal shaft 1511 of the second inner frame 151 are pivotally coupled to the corresponding hooks 111 of the keycap 11, the slidable shaft 1412 of the first inner frame 141 and the slidable shaft 1512 of the second inner frame 151 are pivotally coupled to the corresponding hooks 182 of the base plate 18, the pivotal shaft 1421 of the first outer frame 142 and the pivotal shaft 1521 of the second outer frame 152 are pivotally coupled to the corresponding hooks 181 of the base plate 18, and the slidable shaft 1422 of the first outer frame 142 and the slidable shaft 1522 are inserted into the corresponding sliding grooves 112 of the keycap 11. With the assistance of the first scissors-type connecting element 14 and the second scissors-type connecting element 15, the keycap 11 can be moved upwardly or downwardly relative to the base plate 18 along a specified path.

In the key structure 1 of this embodiment, the elastic element 16 and the membrane switch 17 are arranged between the keycap 11 and the base plate 18. While the keycap 11 is pressed down, the elastic element 16 is compressed and subjected to deformation. Consequently, the membrane switch 17 is triggered to generate a pressing signal. When the keycap 11 is no longer pressed, the elastic element 16 is restored to its original shape from the deformation state. At the same time, the keycap 11 is upwardly pushed by the elastic element 16, and the keycap 11 is returned to its undepressed position.

In the key structure 1 of this embodiment, the reinforced connecting rod 12 and the stabilizer rod 13 are connected with the first scissors-type connecting element 14 and the second scissors-type connecting element 15. The arrangement of the reinforced connecting rod 12 and the stabilizer rod 13 can increase the structural strength and the equilibrium of the first scissors-type connecting element 14 and the second scissors-type connecting element 15 while increasing the stability of the keycap 11 during the upward/downward moving process.

Figure 2A:
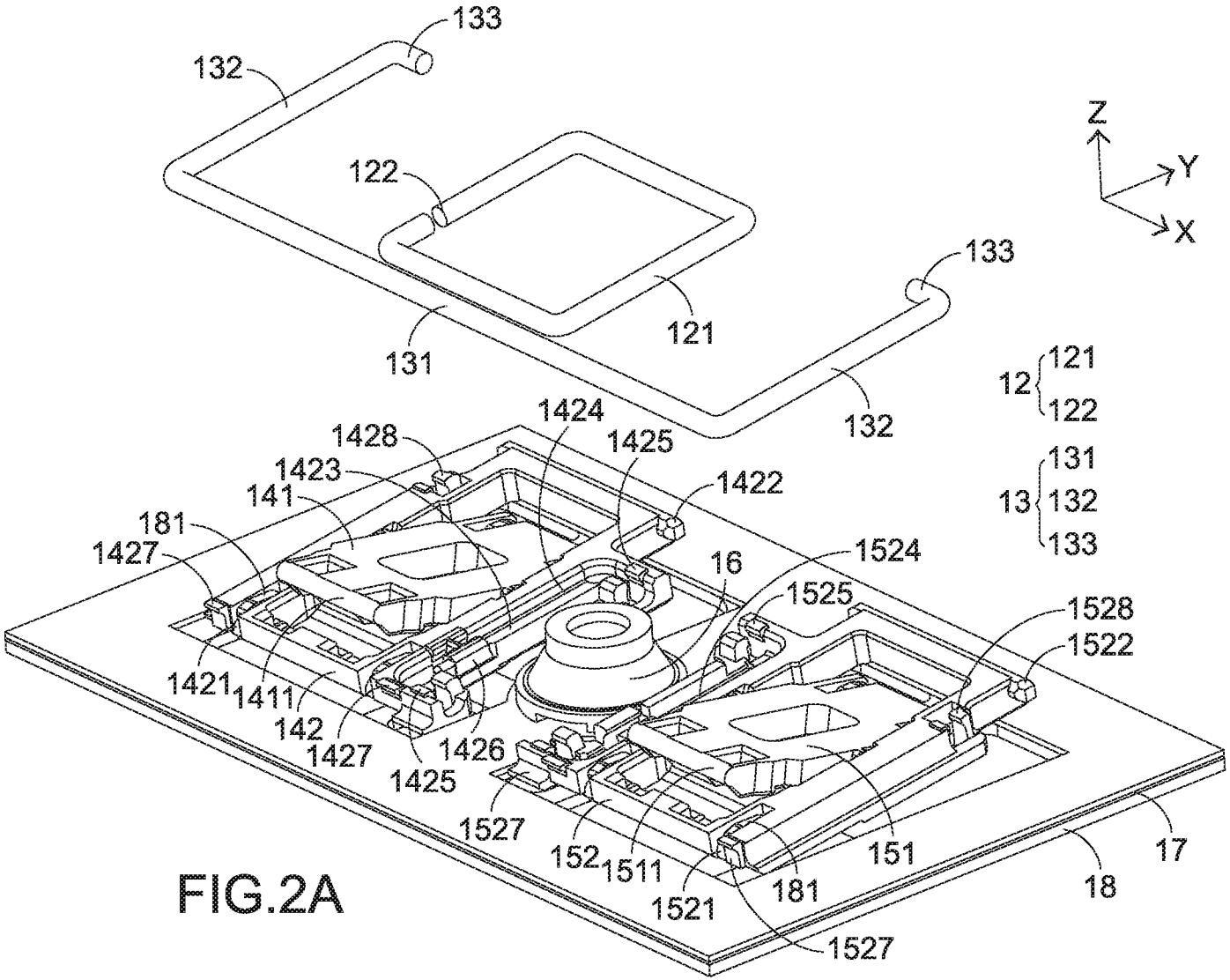
FIG. 2A is a schematic perspective view illustrating the combination of the first scissors-type connecting element, the second scissors-type connecting element, the membrane switch and the base plate in the key structure according to the first embodiment of the present invention.
Figure 2B:
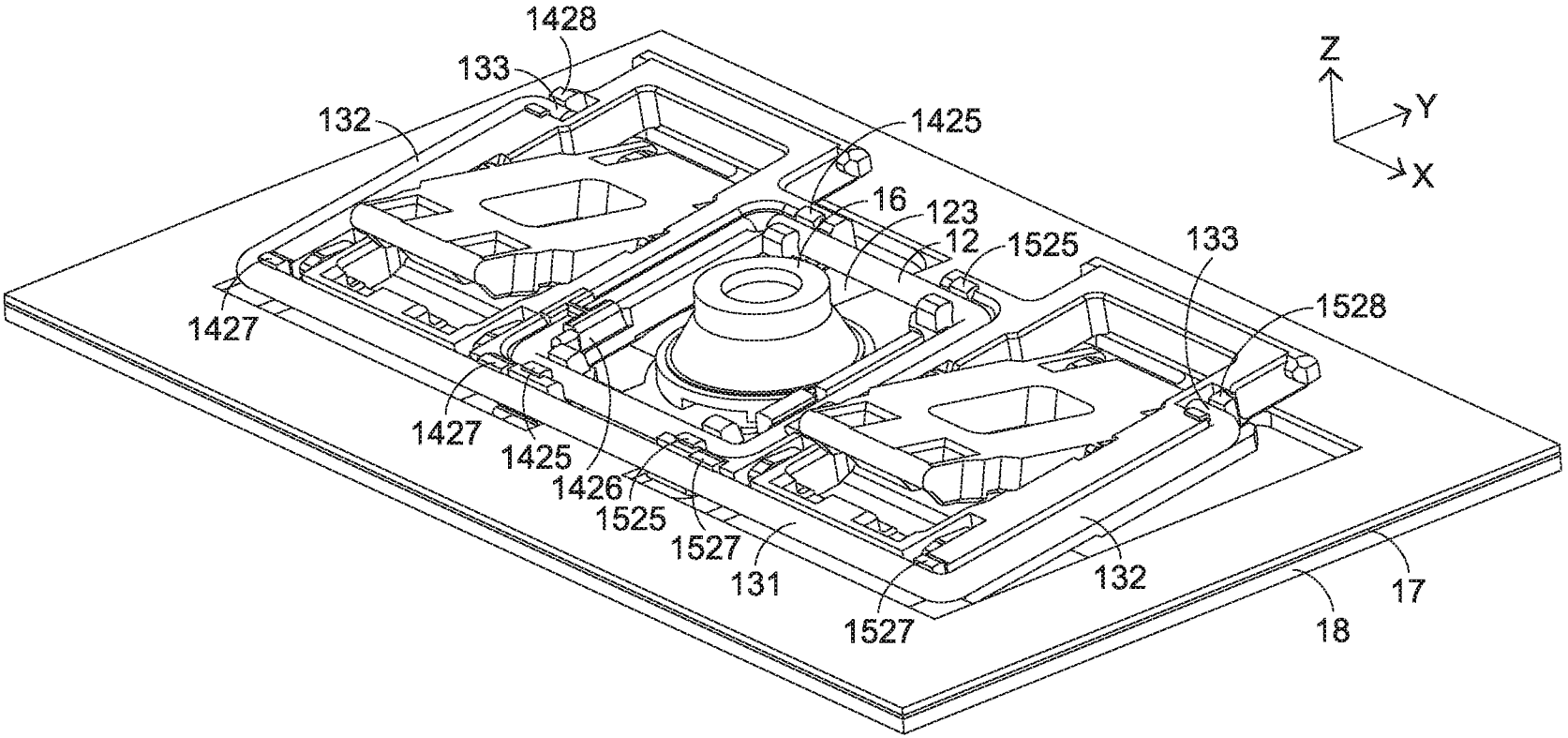
FIG. 2B is a schematic perspective view illustrating the combination of the first scissors-type connecting element, the second scissors-type connecting element, the membrane switch, the base plate, the reinforced connecting rod and the stabilizer rod in the key structure according to the first embodiment of the present invention.
Figure 3A:
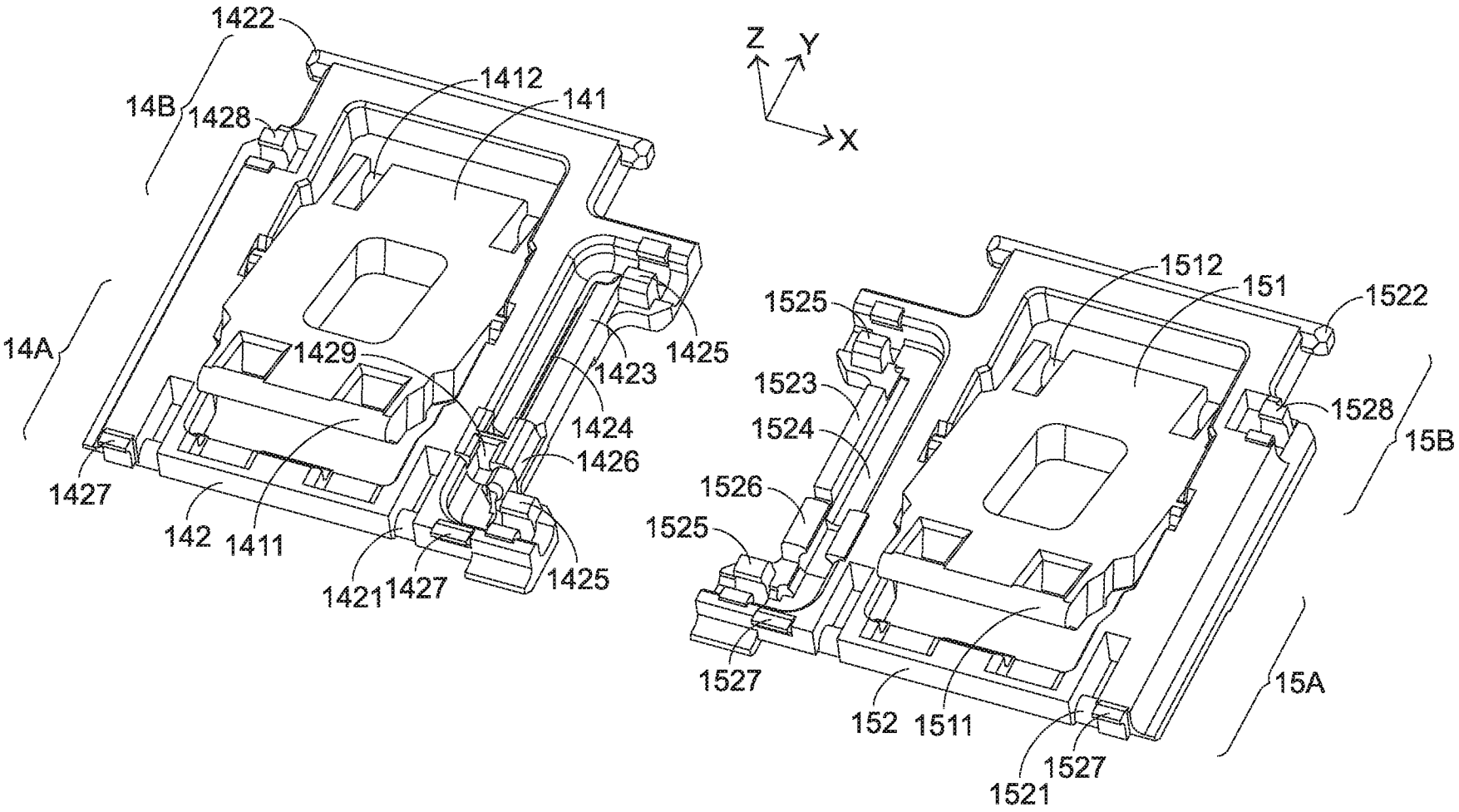
FIG. 3A is a schematic perspective view illustrating the first scissors-type connecting element and the second scissors-type connecting element in the key structure according to the first embodiment of the present invention.
Figure 3B:
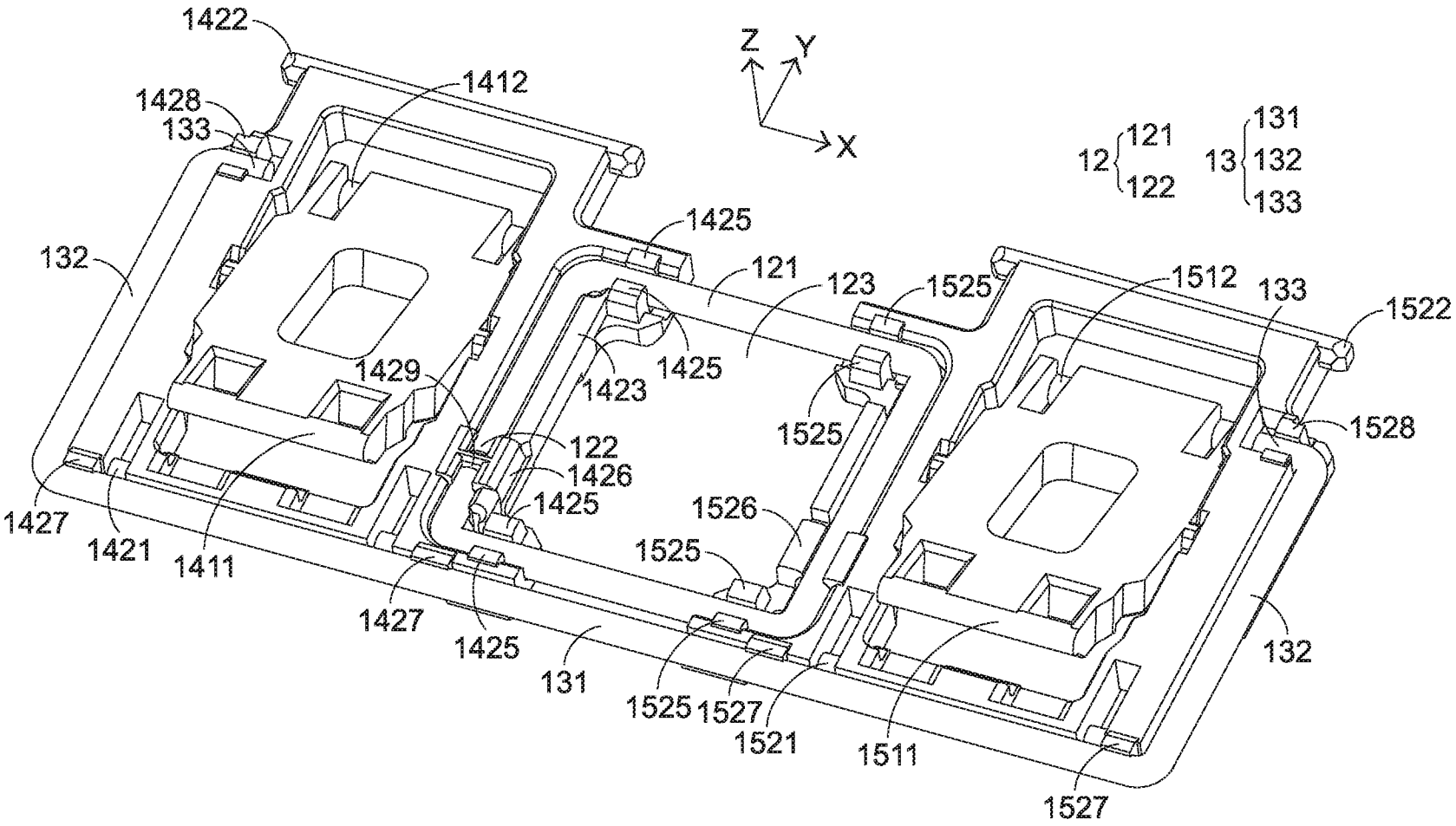
FIG. 3B is a schematic perspective view illustrating the combination of the reinforced connecting rod, the stabilizer rod, the first scissors-type connecting element and the second scissors-type connecting element in the key structure according to the first embodiment of the present invention.
Figure 4A:
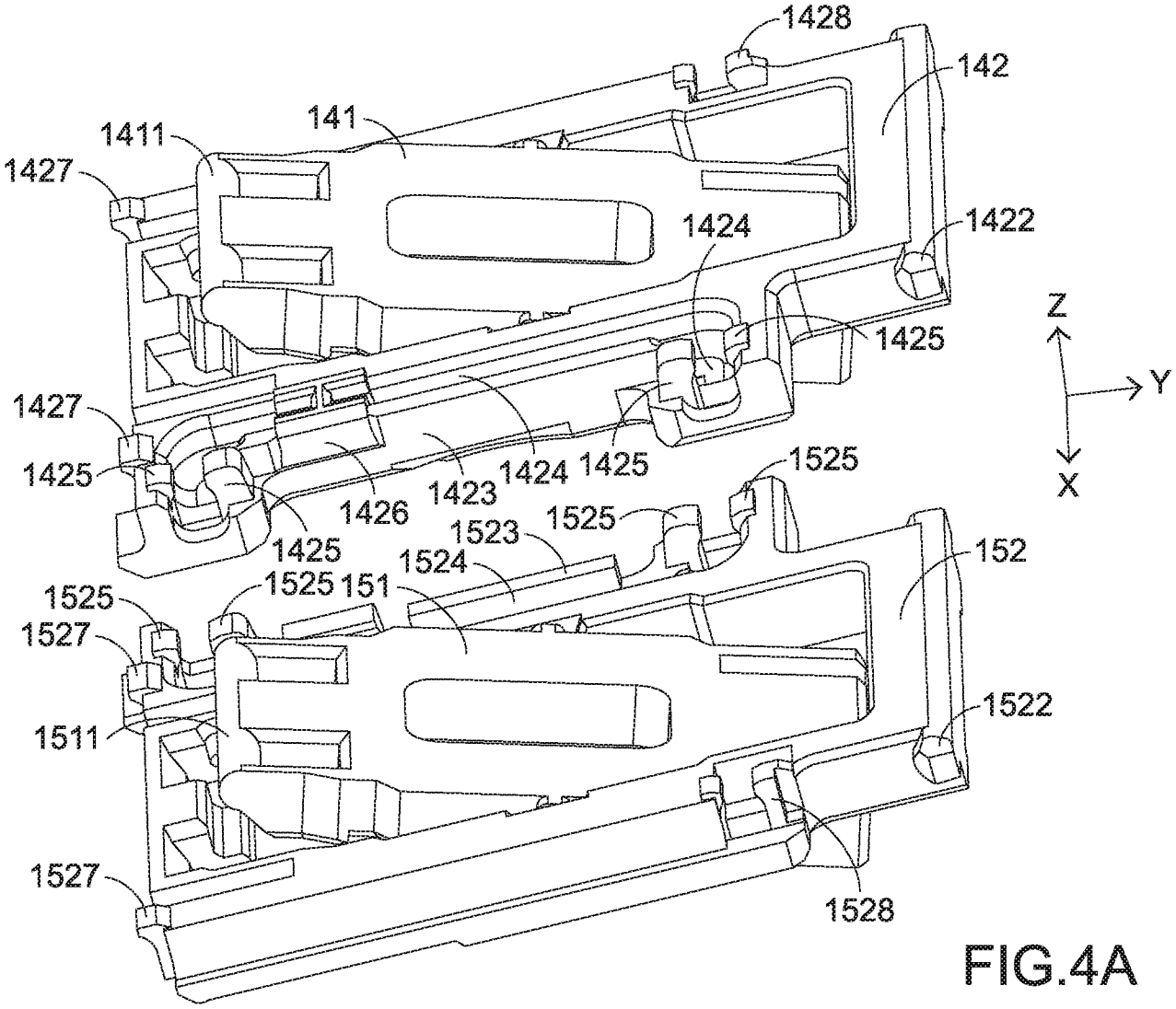
FIG. 4A is a schematic perspective view illustrating the first scissors-type connecting element and the second scissors-type connecting element as shown in FIG. 3A and taken along another viewpoint.
Figure 4B:
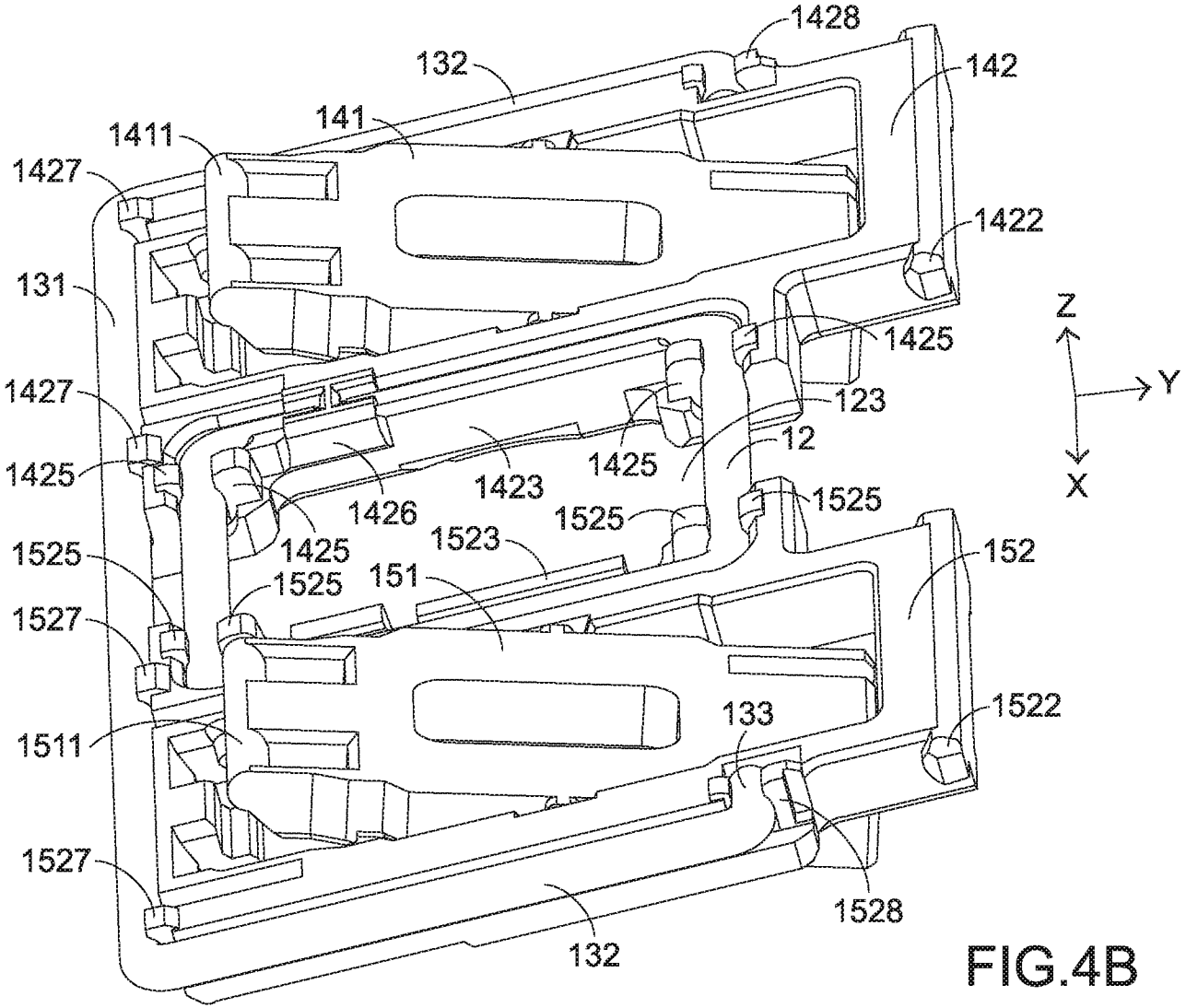
FIG. 4B is a schematic perspective view illustrating the combination of the reinforced connecting rod, the stabilizer rod, the first scissors-type connecting element and the second scissors-type connecting element as shown in FIG. 3B and taken along another viewpoint.

FIG. 2A is a schematic perspective view illustrating the combination of the first scissors-type connecting element, the second scissors-type connecting element, the membrane switch and the base plate in the key structure according to the first embodiment of the present invention. FIG. 2B is a schematic perspective view illustrating the combination of the first scissors-type connecting element, the second scissors-type connecting element, the membrane switch, the base plate, the reinforced connecting rod and the stabilizer rod in the key structure according to the first embodiment of the present invention. FIG. 3A is a schematic perspective view illustrating the first scissors-type connecting element and the second scissors-type connecting element in the key structure according to the first embodiment of the present invention. FIG. 3B is a schematic perspective view illustrating the combination of the reinforced connecting rod, the stabilizer rod, the first scissors-type connecting element and the second scissors-type connecting element in the key structure according to the first embodiment of the present invention. FIG. 4A is a schematic perspective view illustrating the first scissors-type connecting element and the second scissors-type connecting element as shown in FIG. 3A and taken along another viewpoint. FIG. 4B is a schematic perspective view illustrating the combination of the reinforced connecting rod, the stabilizer rod, the first scissors-type connecting element and the second scissors-type connecting element as shown in FIG. 3B and taken along another viewpoint. Please refer to FIGS. 1B, 2A, 2B, 3A, 3B, 4A and 4B.

The first outer frame 142 of the first scissors-type connecting element 14 has a first side and a second side. The second outer frame 152 of the second scissors-type connecting element 15 has a first side and a second side. The first side of the first outer frame 142 is away from the second outer frame 152. The second side of the first outer frame 142 faces the second outer frame 152. The first side of the second outer frame 152 faces the first outer frame 142. The second side of the second outer frame 152 is away from the first outer frame 142. The second side of the first outer frame 142 has an extension structure 1423. A buried recess 1424 is formed in the extension structure 1423. Optionally, two transverse engaging structures 1425 and a longitudinal engaging structure 1426 are installed on the buried recess 1424. The transverse engaging structures 1425 are arranged along the X-axis direction. The longitudinal engaging structure 1426 is arranged along a Y-axis direction. Similarly, the first side of the second outer frame 152 has an extension structure 1523. A buried recess 1524 is formed in the extension structure 1523. Optionally, two transverse engaging structures 1525 and a longitudinal engaging structure 1526 are installed on the buried recess 1524. The transverse engaging structures 1525 are arranged along the X-axis direction. The longitudinal engaging structure 1526 is arranged along the Y-axis direction.

As mentioned above, the extension structure 1423 of the first outer frame 142 and the extension structure 1523 of the second outer frame 152 are arranged along the horizontal direction (i.e., along the direction parallel with the X axis). Consequently, the original structural strength of the first outer frame 142 and the original structural strength of the second outer frame 152 are not adversely affected, and the thicknesses of the first scissors-type connecting element 14 and the second scissors-type connecting element 15 are not increased along the Z-axis direction. In other words, the thickness of the key structure is not increased.

The reinforced connecting rod 12 has a hollow rectangular main body 121 with a hollow portion 123. In this embodiment, the reinforced connecting rod 12 has a notch 122. Alternatively, the reinforced connecting rod 12 is a continuous structure without any notch. Regardless of whether the reinforced connecting rod 12 has the notch or does not have the notch, the design of the reinforced connecting rod 12 can provide sufficient strength to the first scissors-type connecting element 14 and the second scissors-type connecting element 15.

Please refer to FIGS. 2B, 3B and 4B. When the reinforced connecting rod 12 is assembled with the first scissors-type connecting element 14 and the second scissors-type connecting element 15, two opposite sides of the main body 121 are received within the buried recess 1424 of the extension structure 1423 and the buried recess 1524 of the extension structure 1523, respectively. Moreover, since the main body 121 is locked by the engaging structures 1425, 1426, 1525 and 1526, the main body 121 is firmly fixed in the buried recesses 1424 and 1524. Consequently, the first scissors-type connecting element 14 and the second scissors-type connecting element 15 are connected with each other through the reinforced connecting rod 12. Due to the designs of the buried recesses 1424 and 1524 and the engaging structures 1425, 1426, 1525 and 1526, the reinforced connecting rod 12 can be directly pressed into the first scissors-type connecting element 14 and the second scissors-type connecting element 15 from the top side to the bottom side along the Z-axis direction. This assembling method that only requires the linear motion is intuitive and easy. Consequently, the assembling method can be automated.

As mentioned above, the reinforced connecting rod 12 has the hollow rectangular main body 121. The hollow rectangular main body 121 has the ability of withstanding the torsional torque. Consequently, the force can be transmitted from the first outer frame 142 to the second outer frame 152 or transmitted from the second outer frame 152 to the first outer frame 142. Since the strength between the first outer frame 142 and the second outer frame 152 is increased, the stability of the keycap 11 during the upward/downward moving process can be increased.

As mentioned above, the reinforced connecting rod 12 has the notch 122. Optionally, the first outer frame 142 further comprise an upright stopping wall 1429 corresponding to the engaging structure 1426 and the buried recess 1424. When the reinforced connecting rod 12 is assembled with the first scissors-type connecting element 14, the stopping wall 1429 is accommodated within the notch 122. Since the notch 122 cannot be easily found, the integrity of the rectangular profile of the main body 121 can be maintained. Moreover, since the reinforced connecting rod 12 is nearly a closed ring structure, the strength of the reinforced connecting rod 12 and the integrity of the hollow rectangular main body 121 are enhanced.

Moreover, the buried recess 1424 in the extension structure 1423 of the first outer frame 142 and the buried recess 1524 in the extension structure 1523 of the second outer frame 152 are buried structures that are concavely formed in flat surfaces (i.e., downwardly extended from the flat surfaces). Consequently, when the reinforced connecting rod 12 is installed in the buried recesses 1524 and 1525, the reinforced connecting rod 12 is not protruded over the first outer frame 142 and the second outer frame 152 and the appearance is not adversely affected. Moreover, the thicknesses of the first scissors-type connecting element 14, the second scissors-type connecting element 15 and the key structure 1 are not increased. Moreover, since the possibility of causing the contact between the reinforced connecting rod 12 and the keycap 11 is minimized, the possibility of generating the collision noise is largely reduced.

In addition to the reinforced connecting rod 12, the stabilizer rod 13 of the key structure 1 is connected with the first scissors-type connecting element 14 and the second scissors-type connecting element 15. The arrangement of the stabilizer rod 13 can increase the structural strength and the equilibrium of the first scissors-type connecting element 14 and the second scissors-type connecting element 15 while increasing the stability of the keycap 11 during the upward/downward moving process.

Please refer to FIGS. 1B, 2A, 2B, 3A, 3B, 4A and 4B again. The first outer frame 142 of the first scissors-type connecting element 14 is further equipped with two transverse locking grooves 1427 at the outer side of the fixed end 14A of the first scissors-type connecting element 14. The transverse locking grooves 1427 are arranged along the X-axis direction. The first outer frame 142 of the first scissors-type connecting element 14 is further equipped with a buried-type transverse engaging structure 1428 at the first side of the first outer frame 142 (i.e., the side away from the second outer frame 152). The buried-type transverse engaging structure 1428 is arranged along the X-axis direction. The second outer frame 152 of the second scissors-type connecting element 15 is further equipped with two transverse locking grooves 1527 at the outer side of the fixed end 15A of the second scissors-type connecting element 15. The transverse locking grooves 1527 are arranged along the X-axis direction. The second outer frame 152 of the second scissors-type connecting element 15 is further equipped with a buried-type transverse engaging structure 1528 at the second side of the second outer frame 152 (i.e., the side away from the first outer frame 142). The buried-type transverse engaging structure 1528 is arranged along the X-axis direction.

The stabilizer rod 13 comprises a main rod part 131, two first bent parts 132 and two second bent parts 133. Each first bent part 132 is arranged between the main rod part 131 and the corresponding second bent part 133. The two first bent parts 132 are formed by inwardly bending the two ends of the main rod part 131 at a specified angle (e.g., 90 degrees). After the end of the first bent part 132 away from the main rod part 131 is bent at a specified angle (e.g., 90 degrees), the corresponding second bent part 133 is formed.

Please refer to FIGS. 2B, 3B and 4B again. When the stabilizer rod 13 is assembled with the first scissors-type connecting element 14 and the second scissors-type connecting element 15, the main rod part 131 is received within the transverse locking grooves 1427 and 1527. The two first bent parts 132 are disposed on first side of the first outer frame 142 (i.e., the side away from the second outer frame 152) and the second side of the second outer frame 152 (i.e., the side away from the first outer frame 142), respectively. The two second bent parts 133 are locked into the corresponding buried transverse engaging structures 1428 and 1528. Consequently, the first scissors-type connecting element 14 and the second scissors-type connecting element 15 are connected with each other through the stabilizer rod 13.

Due to the arrangement of the stabilizer rod 13, the structural stability of the fixed end 14A of the first scissors-type connecting element 14 and the structural stability of the fixed end 15A of the second scissors-type connecting element 15 are increased. The stabilizer rod 13 has the ability of withstanding the torsional torque. Consequently, the force can be transmitted from the first outer frame 142 to the second side of the second outer frame 152 (i.e., the side away from the first outer frame 142) or transmitted from the second outer frame 152 to the first side of the first outer frame 142 (i.e., the side away from the second outer frame 152). In this embodiment, the stabilizer rod 13 is installed on the outer sides of the fixed end 14A and 15A of the scissors-type connecting elements 14 and 15 rather than the outer sides or top sides of the slidable ends 14B and 15B. Since the stabilizer rod 13 is made of metallic material and has a certain weight, the degree of swinging the keycap 11 during the upward/downward moving process is largely reduced, the stability of the keycap 11 during the upward/downward moving process is enhanced, and the generated noise from the collision between the stabilizer rod 13 and the base plate 18 is reduced.

In this embodiment, the two second bent parts 133 of the stabilizer rod 13 are locked into the corresponding buried transverse engaging structures 1428 and 1528. Consequently, when the stabilizer rod 13 is assembled with the first outer frame 142 and the second outer frame 152, the stabilizer rod 13 is not protruded upwardly. Consequently, the thickness of the key structure 1 is increased, and the stabilizer rod 13 is not contacted with the keycap 11 to generate noise.

Figure 5A:
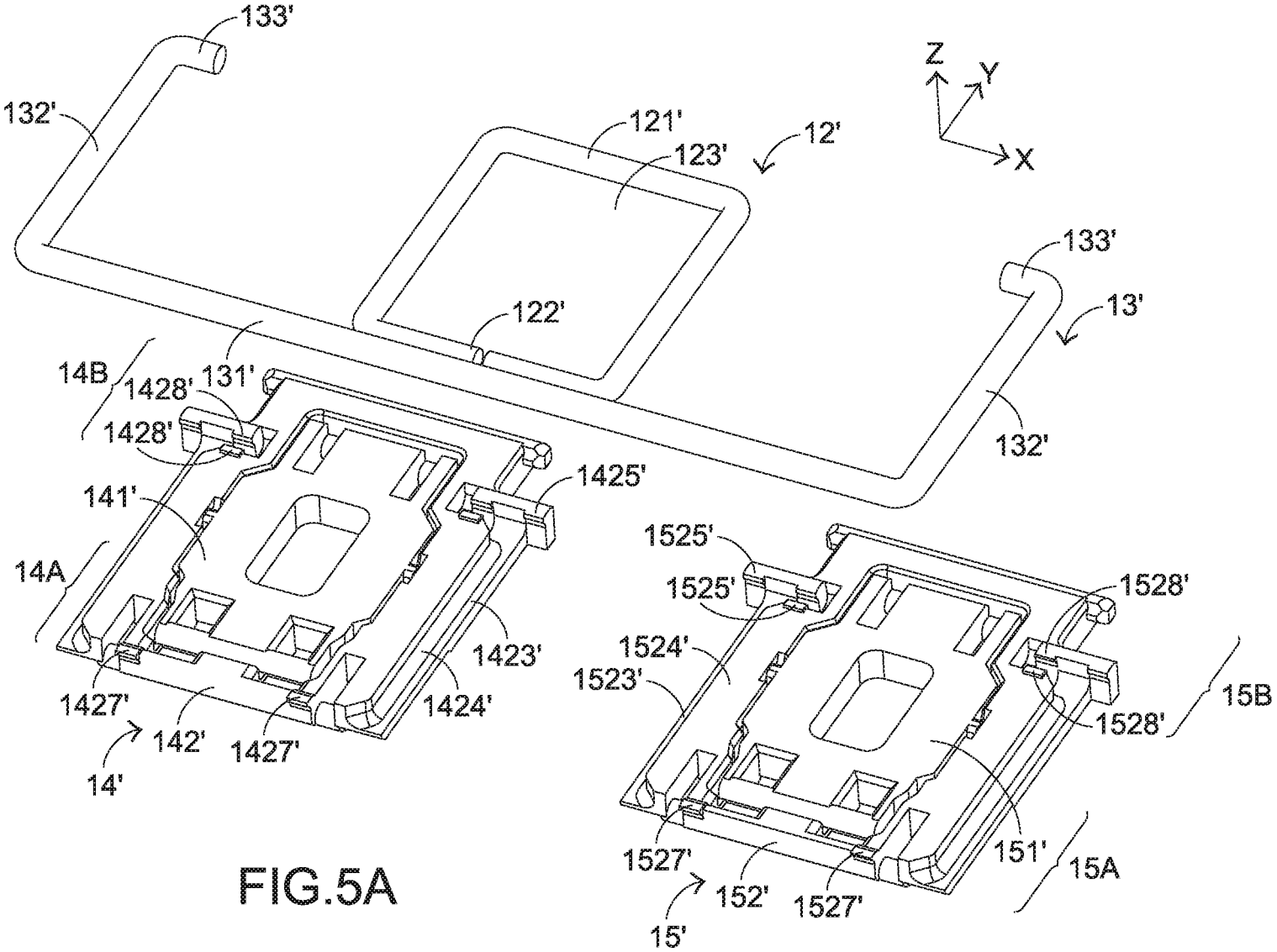
FIGS. 5A and 5B are schematic exploded and perspective view illustrating a reinforced connecting rod, a stabilizer rod, a first scissors-type connecting element and a second scissors-type connecting element of a key structure according to a second embodiment of the present invention.
Figure 5B:
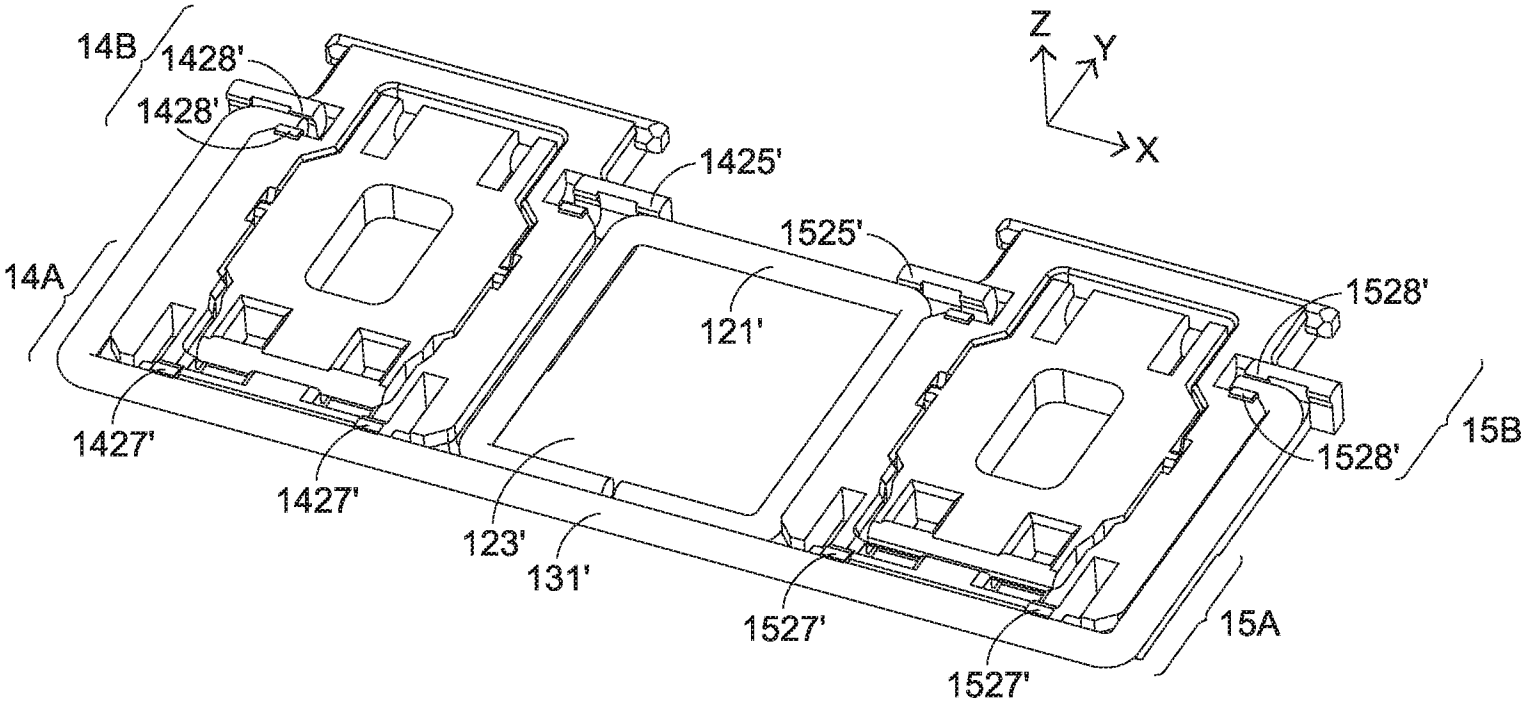

The reinforced connecting rod 12, the stabilizer rod 13, the first scissors-type connecting element 14 and the second scissors-type connecting element 15 may be modified. FIGS. 5A and 5B are schematic exploded and perspective view illustrating a reinforced connecting rod, a stabilizer rod, a first scissors-type connecting element and a second scissors-type connecting element of a key structure according to a second embodiment of the present invention. When the reinforced connecting rod 12', the stabilizer rod 13', the first scissors-type connecting element 14' and the second scissors-type connecting element 15' are applied to the key structure 1, the structural strength and the equilibrium of the first scissors-type connecting element 14' and the second scissors-type connecting element 15' are increased and the stability of the keycap 11 during the upward/downward moving process is enhanced.

Please refer to FIGS. 5A and 5B. Similarly, the reinforced connecting rod 12' has the hollow rectangular main body 121'. In this embodiment, the reinforced connecting rod 12' has a notch 122'. Alternatively, the reinforced connecting rod 12' is a continuous structure without any notch. Similarly, the stabilizer rod 13' comprises a comprises a main rod part 131', two first bent parts 132' and two second bent parts 133'. Each first bent part 132' is arranged between the main rod part 131' and the corresponding second bent part 133'. The two first bent parts 132' are formed by inwardly bending the two ends of the main rod part 131' at a specified angle (e.g., 90 degrees). After the end of the first bent part 132' away from the main rod part 131' is bent at a specified angle (e.g., 90 degrees), the corresponding second bent part 133' is formed. In this embodiment, the reinforced connecting rod 12' and the stabilizer rod 13' are combined together through a fixing means. For example, the fixing means includes a welding means or any other appropriate coupling means. Alternatively, the reinforced connecting rod 12' and the stabilizer rod 13' are integrally formed as a one-piece structure.

Similarly, the second side of the first outer frame 142' of the first scissors-type connecting element 14' (i.e., the side faces the second outer frame 152') has an extension structure 1423', a buried recess 1424' is formed in the extension structure 1423', and two transverse engaging structures 1425' are installed on the buried recess 1424' along the X-axis direction. Similarly, the first side of the second outer frame 152' of the second scissors-type connecting element 15' (i.e., the side faces the first outer frame 142') has an extension structure 1523', a buried recess 1524' is formed in the extension structure 1523', and two transverse engaging structures 1525' are installed on the buried recess 1524' along the X-axis direction.

Please refer to FIG. 5B again. When the reinforced connecting rod 12' is assembled with the first scissors-type connecting element 14' and the second scissors-type connecting element 15', two opposite sides of the main body 121' of the reinforced connecting rod 12' are received within the buried recesses 1424' and 1524', respectively. Moreover, since the main body 121 is locked by the transverse engaging structures 1425' and 1525', the main body 121' is firmly fixed in the buried recesses 1424' and 1524'. Consequently, the first scissors-type connecting element 14' and the second scissors-type connecting element 15' are connected with each other through the reinforced connecting rod 12'.

The first outer frame 142' of the first scissors-type connecting element 14' is further equipped with two transverse locking grooves 1427' at the outer side of the fixed end 14A of the first scissors-type connecting element 14'. The transverse locking grooves 1427' are arranged along the X-axis direction. The first outer frame 142' of the first scissors-type connecting element 14' is further equipped with a buried-type transverse engaging structure 1428' at the first side of the first outer frame 14' (i.e., the side away from the second outer frame 152'). The buried-type transverse engaging structure 1428' is arranged along the X-axis direction. The second outer frame 152' of the second scissors-type connecting element 15' is further equipped with two transverse locking grooves 1527' at the outer side of the fixed end 15A of the second scissors-type connecting element 15. The transverse locking grooves 1527' are arranged along the X-axis direction. The second outer frame 152' of the second scissors-type connecting element 15' is further equipped with a buried-type transverse engaging structure 1528' at the second side of the second outer frame 15' (i.e., the side away from the first outer frame 142'). The buried-type transverse engaging structure 1528' is arranged along the X-axis direction.

Please refer to FIG. 5B again. When the stabilizer rod 13' is assembled with the first scissors-type connecting element 14' and the second scissors-type connecting element 15', the main rod part 131' is received within the transverse locking grooves 1427' and 1527'. The two first bent parts 132' are disposed on first side of the first outer frame 14' (i.e., the side away from the second outer frame 152') and the second side of the second outer frame 15' (i.e., the side away from the first outer frame 142'), respectively. The two second bent parts 133' are locked into the corresponding buried transverse engaging structures 1428' and 1528'. Consequently, the first scissors-type connecting element 14' and the second scissors-type connecting element 15' are connected with each other through the stabilizer rod 13'.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a keycap;

a base plate;

a first scissors connecting element arranged between the keycap and the base plate, wherein the first scissors connecting element is upwardly assembled with the keycap and downwardly assembled with the base plate, and the first scissors connecting element comprises a first inner frame and a first outer frame;

a second scissors connecting element arranged between the keycap and the base plate, wherein the second scissors connecting element is upwardly assembled with the keycap and downwardly assembled with the base plate, and the second scissors connecting element comprises a second inner frame and a second outer frame, wherein the keycap is movable upwardly or downwardly relative to the base plate along a specified path with assistance from the first scissors connecting element and the second scissors connecting element; and a reinforced connecting rod comprising a hollow rectangular main body, wherein a first side of the first outer frame is away from the second outer frame, a second side of the first outer frame faces the second outer frame, a first side of the second outer frame faces the first outer frame, and a second side of the second outer frame is away from the first outer frame, wherein the second side of the first outer frame has a first extension structure, the first side of the second outer frame has a second extension structure, and two opposite sides of the hollow rectangular main body are respectively received within the first extension structure and the second extension structure.

2. The key structure according to claim 1, wherein the first extension structure comprises a first buried recess, the second extension structure comprises a second buried recess, and the two opposite sides of the hollow rectangular main body are respectively received within the first buried recess and the second buried recess.

3. The key structure according to claim 2, wherein at least one first transverse engaging structure is installed on the first buried recess, and at least one second transverse engaging structure is installed on the second buried recess, wherein the reinforced connecting rod is fixed in the first buried recess and the second buried recess through the at least one first transverse engaging structure and the at least one second transverse engaging structure.

4. The key structure according to claim 2, wherein at least one first longitudinal engaging structure is installed on the first buried recess, and at least one second longitudinal engaging structure is installed on the second buried recess, wherein the reinforced connecting rod is fixed in the first buried recess and the second buried recess through the at least one first longitudinal engaging structure and the at least one second longitudinal engaging structure.

5. The key structure according to claim 4, wherein the reinforced connecting rod comprises a notch, and an upright stopping wall is formed in the at least one first longitudinal engaging structure, wherein the stopping wall is accommodated within the notch.

6. The key structure according to claim 1, wherein the first scissors connecting element has a first fixed end and a first slidable end, the second scissors connecting element has a second fixed end and a second slidable end, and the key structure further comprises a stabilizer rod with a main rod part, two first bent parts and two second bent parts, wherein each first bent part is arranged between the main rod part and a corresponding second bent part, the two first bent parts are formed by inwardly bending two ends of the main rod part at a specified angle, and each second bent part is formed by bending an end of a corresponding first bent part that is located away from the main rod part, wherein the first outer frame comprises at least one first transverse locking groove at an outer side of the first fixed end, the first side of the first outer frame comprises a buried first transverse engaging structure, the second outer frame comprises at least one second transverse locking groove at an outer side of the second fixed end, and the second side of the second outer frame comprises a buried second transverse engaging structure, wherein the main rod part is received within the at least one first transverse locking groove and the at least one second transverse locking groove, and the two second bent parts are respectively locked into the first transverse engaging structure and the second transverse engaging structure, so that the first scissors connecting element and the second scissors connecting element are connected with each other through the stabilizer rod.

7. A key structure, comprising:

a keycap;

a base plate;

a first scissors connecting element arranged between the keycap and the base plate, wherein the first scissors connecting element is upwardly assembled with the keycap and downwardly assembled with the base plate, wherein the first scissors connecting element comprises a first inner frame and a first outer frame, and the first scissors connecting element has a first fixed end and a first slidable end;

a second scissors connecting element arranged between the keycap and the base plate, wherein the second scissors connecting element is upwardly assembled with the keycap and downwardly assembled with the base plate, wherein the second scissors connecting element comprises a second inner frame and a second outer frame, and the second scissors connecting element has a second fixed end and a second slidable end, wherein the keycap is movable upwardly or downwardly relative to the base plate along a specified path with assistance from the first scissors connecting element and the second scissors connecting element; and a stabilizer rod comprising a main rod part, two first bent parts and two second bent parts, wherein each first bent part is arranged between the main rod part and a corresponding second bent part, the two first bent parts are formed by inwardly bending two ends of the main rod part at a specified angle, and each second bent part is formed by bending an end of a corresponding first bent part that is located away from the main rod part, wherein a first side of the first outer frame is away from the second outer frame, a second side of the first outer frame faces the second outer frame, a first side of the second outer frame faces the first outer frame, and a second side of the second outer frame is away from the first outer frame, wherein the first outer frame comprises at least one first transverse locking groove at an outer side of the first fixed end, the first side of the first outer frame comprises a buried first transverse engaging structure, the second outer frame comprises at least one second transverse locking groove at an outer side of the second fixed end, and the second side of the second outer frame comprises a buried second transverse engaging structure, wherein the main rod part is received within the at least one first transverse locking groove and the at least one second transverse locking groove, and the two second bent parts are respectively locked into the first transverse engaging structure and the second transverse engaging structure, so that the first scissors connecting element and the second scissors connecting element are connected with each other through the stabilizer rod.

8. The key structure according to claim 7, wherein the key structure further comprises a reinforced connecting rod with a hollow rectangular main body, wherein the second side of the first outer frame has a first extension structure, the first side of the second outer frame has a second extension structure, and two opposite sides of the hollow rectangular main body are respectively received within the first extension structure and the second extension structure.

9. The key structure according to claim 8, wherein the first extension structure comprises a first buried recess, the second extension structure comprises a second buried recess, and the two opposite sides of the hollow rectangular main body are respectively received within the first buried recess and the second buried recess.

10. The key structure according to claim 9, wherein at least one third transverse engaging structure is installed on the first buried recess, and at least one fourth transverse engaging structure is installed on the second buried recess, wherein the reinforced connecting rod is fixed in the first buried recess and the second buried recess through the at least one third transverse engaging structure and the at least one fourth transverse engaging structure.

11. The key structure according to claim 9, wherein at least one first longitudinal engaging structure is installed on the first buried recess, and at least one second longitudinal engaging structure is installed on the second buried recess, wherein the reinforced connecting rod is fixed in the first buried recess and the second buried recess through the at least one first longitudinal engaging structure and the at least one second longitudinal engaging structure.

12. The key structure according to claim 11, wherein the reinforced connecting rod comprises a notch, and an upright stopping wall is formed in the at least one first longitudinal engaging structure, wherein the stopping wall is accommodated within the notch.

13. A key structure, comprising:

a keycap;

a base plate;

a first scissors connecting element arranged between the keycap and the base plate, wherein the first scissors connecting element is upwardly assembled with the keycap and downwardly assembled with the base plate, wherein the first scissors connecting element comprises a first inner frame and a first outer frame, and the first scissors connecting element has a first fixed end and a first slidable end;

a second scissors connecting element arranged between the keycap and the base plate, wherein the second scissors connecting element is upwardly assembled with the keycap and downwardly assembled with the base plate, wherein the second scissors connecting element comprises a second inner frame and a second outer frame, and the second scissors connecting element has a second fixed end and a second slidable end, wherein a first side of the first outer frame is away from the second outer frame, a second side of the first outer frame faces the second outer frame, a first side of the second outer frame faces the first outer frame, and a second side of the second outer frame is away from the first outer frame, wherein the second side of the first outer frame has a first extension structure, and the first side of the second outer frame has a second extension structure, wherein the first outer frame comprises at least one first transverse locking groove at an outer side of the first fixed end, the first side of the first outer frame comprises a buried first transverse engaging structure, the second outer frame comprises at least one second transverse locking groove at an outer side of the second fixed end, and the second side of the second outer frame comprises a buried second transverse engaging structure;

a reinforced connecting rod comprising a hollow rectangular main body, wherein two opposite sides of the hollow rectangular main body are respectively received within the first extension structure and the second extension structure; and a stabilizer rod comprising a main rod part, two first bent parts and two second bent parts, wherein each first bent part is arranged between the main rod part and a corresponding second bent part, the two first bent parts are formed by inwardly bending two ends of the main rod part at a specified angle, and each second bent part is formed by bending an end of a corresponding first bent part that is located away from the main rod part, wherein the main rod part is received within the at least one first transverse locking groove and the at least one second transverse locking groove, and the two second bent parts are respectively locked into the first transverse engaging structure and the second transverse engaging structure, the main rod part and the reinforced connecting rod are connected with each other.

14. The key structure according to claim 13, wherein the first extension structure comprises a first buried recess, and the second extension structure comprises a second buried recess, wherein a third transverse engaging structure is installed on the first buried recess, and a fourth transverse engaging structure is installed on the second buried recess, wherein the two opposite sides of the hollow rectangular main body of the reinforced connecting rod are respectively received within the first buried recess and the second buried recess, and the reinforced connecting rod is fixed in the first buried recess and the second buried recess through the third transverse engaging structure and the fourth transverse engaging structure.

* * * * *